US011753205B2

(12) United States Patent
Lin

(10) Patent No.: US 11,753,205 B2
(45) Date of Patent: Sep. 12, 2023

(54) FOLDING CONTAINER

(71) Applicants: Tsai-Hui Lin, Kaohsiung (TW); SORTNOVA LLC, Cheyenne, WY (US)

(72) Inventor: Tsai-Hui Lin, Kaohsiung (TW)

(73) Assignees: Tsai-Hui Lin, Kaohsiung (TW); SortNova LLC, Cheyenna, WY (US)

( * ) Notice: Subject to any disclaimer, the term of this patent is extended or adjusted under 35 U.S.C. 154(b) by 0 days.

(21) Appl. No.: 17/658,135

(22) Filed: Apr. 6, 2022

(65) Prior Publication Data

US 2023/0202709 A1 Jun. 29, 2023

(30) Foreign Application Priority Data

Dec. 23, 2021 (TW) ..... 110215360

(51) Int. Cl.
*B65D 6/18* (2006.01)

(52) U.S. Cl.
CPC ..... *B65D 11/1853* (2013.01)

(58) Field of Classification Search
CPC . B65D 11/1853; B65D 11/1846; B65D 11/18; B65D 11/1866; B65D 11/1893; B65D 5/36; B65D 5/64; B65D 5/66; B65D 5/6602
See application file for complete search history.

(56) References Cited

U.S. PATENT DOCUMENTS 1,338,664 A * 5/1920 Aviss ..... B65D 5/36 229/125.37
2003/0080125 A1* 5/2003 Cassani ..... B65D 11/1853 220/6
2019/0256253 A1* 8/2019 Van Bree ..... B65D 25/04

FOREIGN PATENT DOCUMENTS

TW M454366 U 6/2013

* cited by examiner

*Primary Examiner* — Stephen J Castellano
(74) *Attorney, Agent, or Firm* — Rosenberg, Klein & Lee

(57) ABSTRACT

A folding container mainly includes a lower base, a front plate, two opposite side plates, an upper cover, and a back plate. The folding container can be extended in use for mounting objects therein or folded for storage while not in use. During extension or folding, touch fasteners are used for fastening and fixing firmly. Thereby the folding container is not only lighter in total weight and able to be folded into a compact form while not in use, but also providing accurate positioning to keep itself from extending freely during folding process. Therefore, the folding container is more convenient to use and more practical in use.

10 Claims, 12 Drawing Sheets

FOLDING CONTAINER

BACKGROUND OF THE INVENTION

Field of the Invention

The present invention relates to a folding container, especially to a folding container which is not only light in total weight and able to be folded into a compact form while not in use, but also providing accurate positioning to keep itself from extending freely during folding process. Thereby the folding container is more convenient to use and more practical in use.

DESCRIPTION OF RELATED ART

People usually use different types of storage containers for storing various objects. The living space is limited in the over-crowded environment and the storage containers occupy certain space while not in use. Thus people in the business have developed folding containers able to be folded for storage while not in use and extended to mount things therein for storage of objects. Thereby more space is available.

Refer to Taiwanese Patent. Pub. No. M454366U, entitled "extendable and foldable storage box structure", published at Jun. 1, 2013, a storage box includes a base assembly portion, a side-plate assembly portion, and an upper cover plate. The base assembly portion is formed by two symmetrical assembly plates and rotating shafts located on a connection area between the two symmetrical assembly plates for mounting each other and able to be extended or folded. A lug is arranged at each of two sides of the connection area between the two symmetrical assembly plates is locked into a sliding slot of a motorcycle foot pad and moved back-and-forth linearly within the sliding slot. The side-plate assembly portion consists of two front and rear side plates and two left and right side plates. A lower side and lateral sides of the front and rear side plates are respectively mounted with the base assembly portion and the left and right side plates by the rotating shafts for being extended or folded. The left and right side plates are formed by two left assembly plates and two right assembly plates symmetrical to each other. A connection area between the symmetrical left assembly plates and the right assembly plates is provided with a rotating shaft for mounted each other and thus extended and folded. The upper cover plate includes a corner which is mounted with an outer side of the rear side plate by a rotating shaft. Thus the upper cover plate is pulled up and then folded to form an upper cover which is covering an opening on top of the side-plate assembly portion and locked with the front side plates by a fastener.

However, while in use, the extendable and foldable storage box mentioned above has shortcomings of poor positioning after being folded and easy extension freely which cause problems in use.

Thus there is room for improvement and there is a need to provide a novel folding container which not only overcomes the above shortcomings but also becomes more convenient to use.

SUMMARY OF THE INVENTION

Therefore, it is a primary object of the present invention to provide a folding container which is not only lighter in total weight and able to be folded into a compact form while not in use, but also providing accurate positioning to keep itself from extending freely during folding process. Thereby the folding container is more convenient to use and more practical in use. Thereby the folding container is more convenient to use and more practical in use.

In order to achieve the above object, a folding container according to the present invention mainly includes a lower base, a front plate, two opposite side plates, an upper cover, and a back plate.

The lower base consists of a bottom plate with a bottom-plate folding touch fastener arranged at a front end of the bottom plate, a foldable front-end connection piece extending from the front end of the bottom plate, two bottom-plate laterally-extending pieces extending from two sides of the bottom plate and each of which is provided with a bottom-plate side-fixing touch fastener, and a bottom-plate rear extension piece extending from a rear end of the bottom plate. A bottom-plate rear-fixing touch fastener and a bottom-plate folding fixing touch fastener are respectively disposed on an inner surface and an outer surface of the bottom-plate rear extension piece.

The front plate in which a lower part thereof is connected and fixed to the front-end connection piece of the lower base is provided with a foldable front connecting piece for side-plate extending from each of two sides of the front plate, and a front-plate covering touch fastener arranged at an outer surface of an upper part of the front plate.

The two side plates are disposed on two sides of the bottom plate of the lower base and a front end of the side plates is connected and fixed to the side-plate connection piece on the two sides of the front plate correspondingly. A fold line is formed at a middle part of the side so that the side plate is able to be folded along the fold line. A side-plate lower-fixing touch fastener which is corresponding to the bottom-plate side-fixing touch fastener of the bottom-plate laterally-extending piece is arranged at a lower part of an outer side of the side plate for being attached and connected to the bottom-plate side-fixing touch fastener to form the container. A handle hole which is a through hole used for assembly of a handle is disposed on an upper part of the side plate and a side-plate upper-fixing touch fastener is arranged at the outer side of the side plate and located above the handle hole.

The upper cover is provided with a cover plate and a cover-plate folding touch fastener is arranged at a rear side of the cover plate and corresponding to the bottom-plate folding fixing touch fastener of the bottom-plate rear extension piece of the lower base for being attached and connected to each other during folding. The rear side of the cover plate is folded downward to form a rear-end connection piece. Two cover-plate laterally-extending pieces are extending from two sides of the cover plate correspondingly and a cover-plate side-fixing touch fastener is mounted to an inner surface of each of the cover-plate laterally-extending pieces and corresponding to the side-plate upper-fixing touch fastener of the side plate for being attached and connected to each other as the folding container is in use. A cover-plate front extension piece is extending from a front side of the cover plate. A cover-plate covering touch fastener is mounted to an inner surface of the cover-plate front extension piece and corresponding to the front-plate covering touch fastener of the front plate for being attached and connected to each other as the folding container is in use. A cover-plate folding fixing touch fastener is arranged at an outer surface of the cover-plate front extension piece and corresponding to the bottom-plate folding touch fastener of the bottom plate of the lower base for being attached and connected to each other during folding.

An upper part of the back plate is connected and fixed to the rear-end connection piece of the upper cover. Two foldable rear connecting pieces for side-plate are extending from two sides of the back plate and each of the rear connecting pieces for side-plate is connected and fixed to a rear end of each of the two side plates correspondingly. A back-plate lower-fixing touch fastener is disposed on a lower part of an outer surface of the back plate and corresponding to the bottom-plate rear-fixing touch fastener of the bottom-plate rear extension piece of the lower base for being attached and connected to each other as the folding container is in use.

Preferably, wherein a bottom-plate foam layer is disposed on a periphery of a top surface of the bottom plate.

Preferably, a bottom-plate reinforcement piece is connected to the top surface of the bottom plate and located within the periphery of the top surface of the bottom plate with the bottom-plate foam layer.

Preferably, a type of connection between the front plate and the front-end connection piece, the side plate and the front connecting piece for side-plate, the back plate and the rear-end connection piece, and the side plate and the rear connecting piece for side-plate is selected from one of the followings: sewing, adhesion, and riveting.

Preferably, a type of connection between the bottom plate and the bottom-plate folding touch fastener, the bottom-plate laterally-extending piece and the bottom-plate side-fixing touch fastener, the bottom-plate rear extension piece and the bottom-plate rear-fixing touch fastener, the bottom-plate rear extension piece and the bottom-plate folding fixing touch fastener, the front plate and the front-plate covering touch fastener, the side plate and the side-plate lower-fixing touch fastener, the side plate and the side-plate upper-fixing touch fastener, the cover plate and the cover-plate folding touch fastener, the cover-plate laterally-extending piece and the cover-plate side-fixing touch fastener, the cover-plate front extension piece and the cover-plate covering touch fastener, the cover-plate front extension piece and the cover-plate folding fixing touch fastener, the back plate and the back-plate lower-fixing touch fastener is selected from one of the followings: sewing, adhesion, and riveting.

Preferably, at least one side-plate shielding touch fastener is disposed on the outer side of the side plate and located below the handle hole while at least one cover-plate side shielding touch fastener is arranged at the inner surface of the cover-plate laterally-extending piece and corresponding to the side-plate shielding touch fastener for being attached and connected to each other as the folding container is in use.

Preferably, a type of connection between the side plate and the side-plate shielding touch fastener, and the cover-plate laterally-extending piece and the cover-plate side shielding touch fastener is selected from the group consisting of sewing, adhesion, and riveting.

Preferably, a cover-plate foam layer is disposed on a periphery of an inner surface of the cover plate.

Preferably, a cover-plate reinforcement piece is connected to the inner surface of the cover plate and located within the periphery of the inner surface of the cover plate with the cover-plate foam layer.

Preferably, the bottom-plate laterally-extending piece and the cover-plate extension piece are both folded and hidden into folded area of the side plate when the side plate is folded inward along the fold line at the middle of the side plate.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, features and functions of the present invention, please refer to the following embodiments with reference to related figures and numbers.

Figure 1:
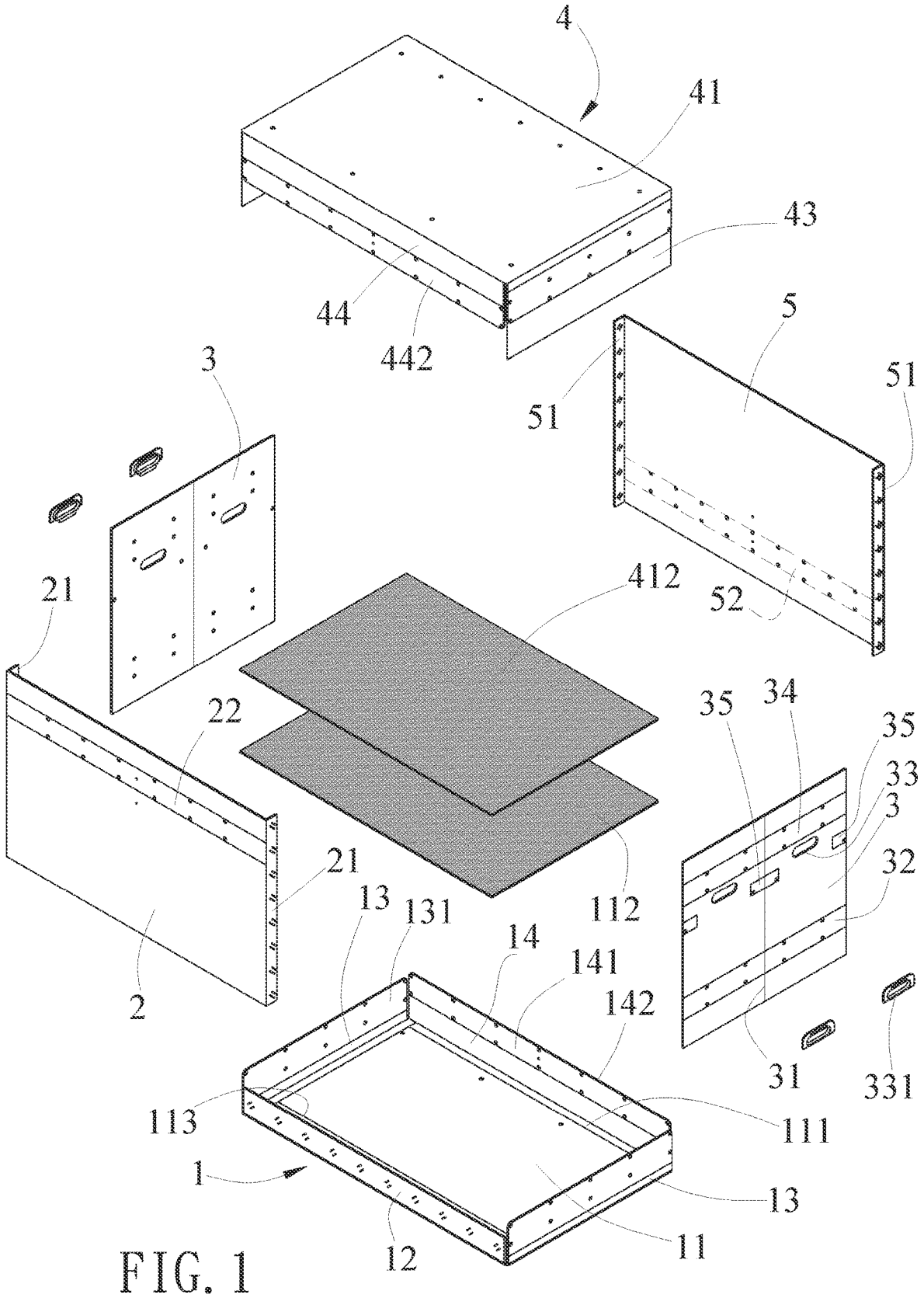
FIG. 1 is an exploded view of an embodiment according to the present invention.
Figure 2:
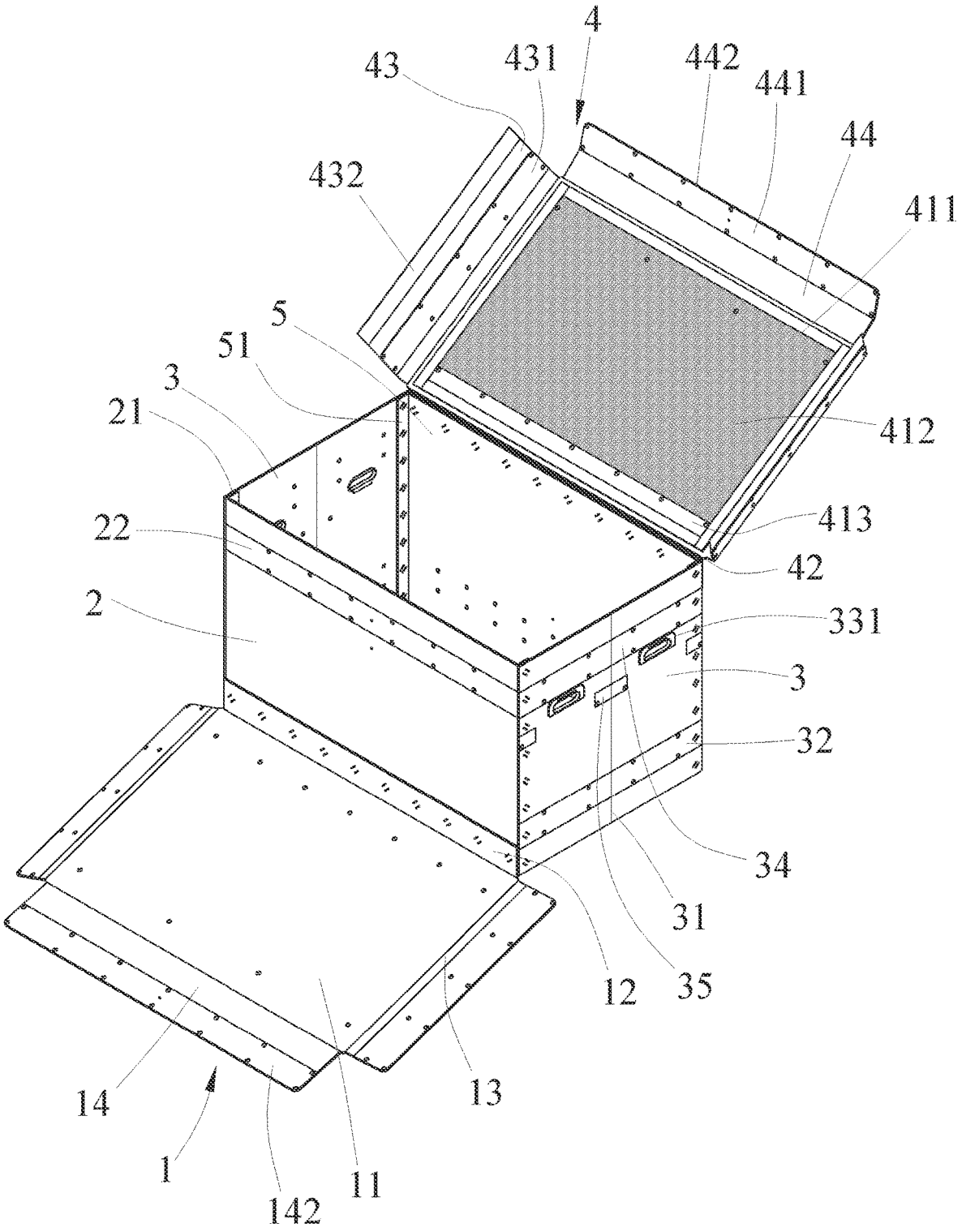
FIG. 2 is a perspective view of an embodiment according to the present invention.

Refer to FIG. 1 and FIG. 2, a folding container according to the present invention mainly includes a lower base 1, a front plate 2, two side plates 3 opposite to each other, an upper cover 4, and a back plate 5.

The lower base 1 consists of a bottom plate 11, a foldable front-end connection piece 12 extending from a front end of the bottom plate 11, two bottom-plate laterally-extending pieces 13 extending from two sides of the bottom plate 11, and a bottom-plate rear extension piece 14 extending from a rear end of the bottom plate 11. The bottom plate 11 is provided with a bottom-plate foam layer 111 disposed on a periphery of a top surface thereof, a bottom-plate reinforcement piece 112 connected to the top surface thereof, and a bottom-plate folding touch fastener 113 which is disposed on the front end thereof by sewing, adhesion, or riveting. The bottom-plate reinforcement piece 112 is located within the periphery of the top surface of the bottom plate 11 with the bottom-plate foam layer 111. A bottom-plate side-fixing touch fastener 131 is arranged at an inner surface of each of the bottom-plate laterally-extending pieces 13 by sewing, adhesion, or riveting. A bottom-plate rear-fixing touch fastener 141 and a bottom-plate folding fixing touch fastener 142 are respectively disposed on an inner surface and an outer surface of the bottom-plate rear extension piece 14 by sewing, adhesion, or riveting.

A lower part of the front plate 2 is connected and fixed to the front-end connection piece 12 of the lower base 1 by sewing, adhesion, or riveting and the front plate 2 is composed of a foldable front connecting piece for side-plate 21 extending from each of two sides of the front plate 2 and a front-plate covering touch fastener 22 arranged at an outer surface of an upper part of the front plate 2.

The two side plates 3 are disposed on two sides of the bottom plate 11 of the lower base 1 correspondingly while a front end of each of the side plates 3 is connected and fixed on the front connecting piece for side-plate 21 on each of the two sides of the front plate 2 correspondingly by sewing, adhesion, or riveting. The side plate 3 consists of a fold line 31 formed at a middle part thereof and along which the side plate 3 is able to be folded, a side-plate lower-fixing touch fastener 32 arranged at a lower part of an outer side thereof by sewing, adhesion, or riveting and corresponding to the bottom-plate side-fixing touch fastener 131 of the bottom-plate laterally-extending piece 13 for adhesion and connection to each other, two handle holes 33 each of which is a through hole used for assembly of a handle 331 and disposed on an upper part of the side plate 3, a side-plate upper-fixing touch fastener 34 located above the handle holes 33 and disposed on the outer side of the side plate 3 by sewing, adhesion, and riveting, and at least one side-plate shielding touch fastener 35 disposed on the outer side of the side plate 3 by sewing, adhesion, or riveting and located below the handle holes 33.

The upper cover 4 is composed of a cover plate 41, a rear-end connection piece 42 formed by a rear side of the cover plate 41 being folded down, two cover-plate laterally-extending pieces 43 extending from two sides of the cover plate 41 correspondingly, and a cover-plate front extension piece 44 extending from a front side of the cover plate 41. A cover-plate foam layer 411 is disposed on a periphery of an inner surface of the cover plate 41 and a cover-plate reinforcement piece 412 is connected to the inner surface of the cover plate 41 and located within the periphery of the inner surface of the cover plate 41 with the cover-plate foam layer 411 while a cover-plate folding touch fastener 413 is arranged at the rear side of the cover plate 41 by sewing, adhesion, or riveting and corresponding to the bottom-plate folding fixing touch fastener 142 of the bottom-plate rear extension piece 14 of the lower base 1. A cover-plate side-fixing touch fastener 431 and a cover-plate side shielding touch fastener 432 are mounted to an inner surface of the cover-plate laterally-extending piece 43 by sewing, adhesion or riveting and corresponding to the side-plate upper-fixing touch fastener 34 and the side-plate shielding touch fastener 35 of the side plate 3 respectively for being attached and connected to each other. A cover-plate covering touch fastener 441 and a cover-plate folding fixing touch fastener 442 are respectively arranged at an inner surface and an outer surface of the cover-plate front extension piece 44 by sewing, adhesion or riveting and corresponding to the front-plate covering touch fastener 22 of the front plate 2 and the bottom-plate folding touch fastener 113 of the bottom plate 11 of the lower base 1 respectively for attachment and connection to each other.

An upper part of the back plate 5 is connected and fixed to the rear-end connection piece 42 of the upper cover 4 by sewing, adhesion, or riveting. A foldable rear connecting piece for side-plate 51 extending from each of two sides of the back plate 5 is connected and fixed to a rear end of each of the side plates 3 correspondingly by sewing, adhesion, or riveting. A back-plate lower-fixing touch fastener 52 is mounted to a lower part of an outer surface of the back plate 5 by sewing, adhesion, or riveting and corresponding to the bottom-plate rear-fixing touch fastener 141 of the bottom-plate rear extension piece 14 of the lower base 1 for being attached and connected to each other.

Figure 3:
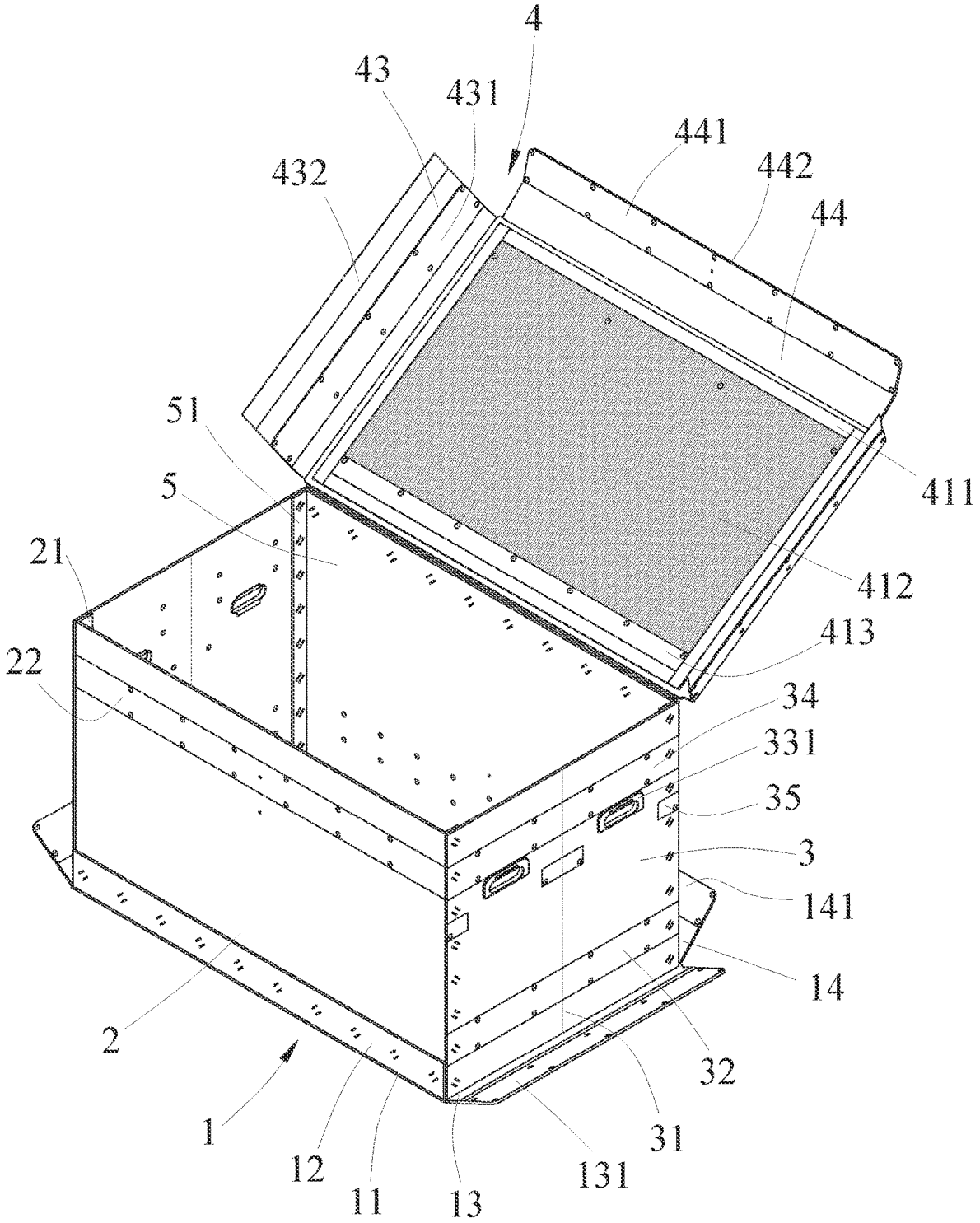
FIG. 3 is a schematic drawing showing an embodiment being extended according to the present invention.
Figure 4:
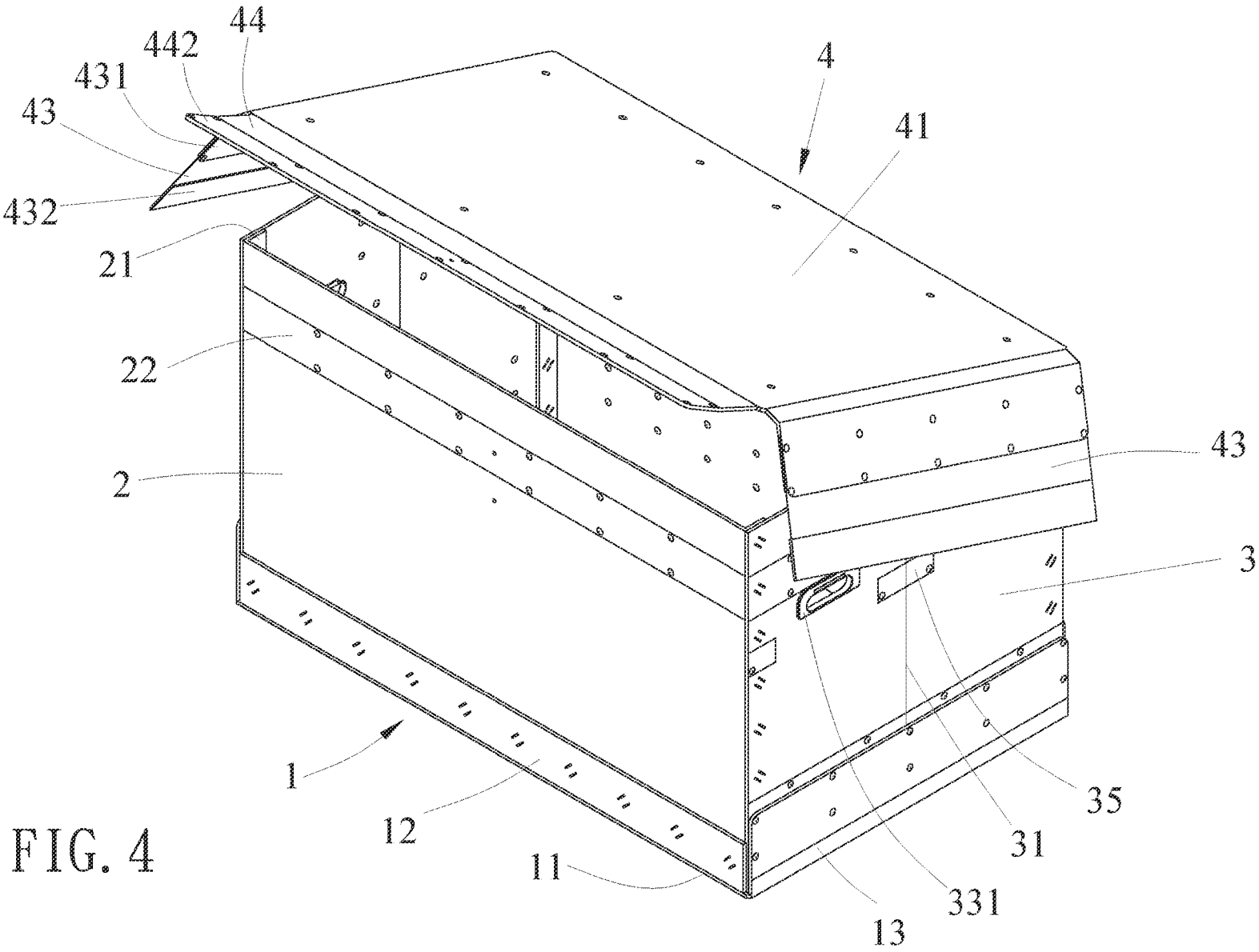
FIG. 4 is another schematic drawing showing an embodiment being extended according to the present invention.
Figure 5:
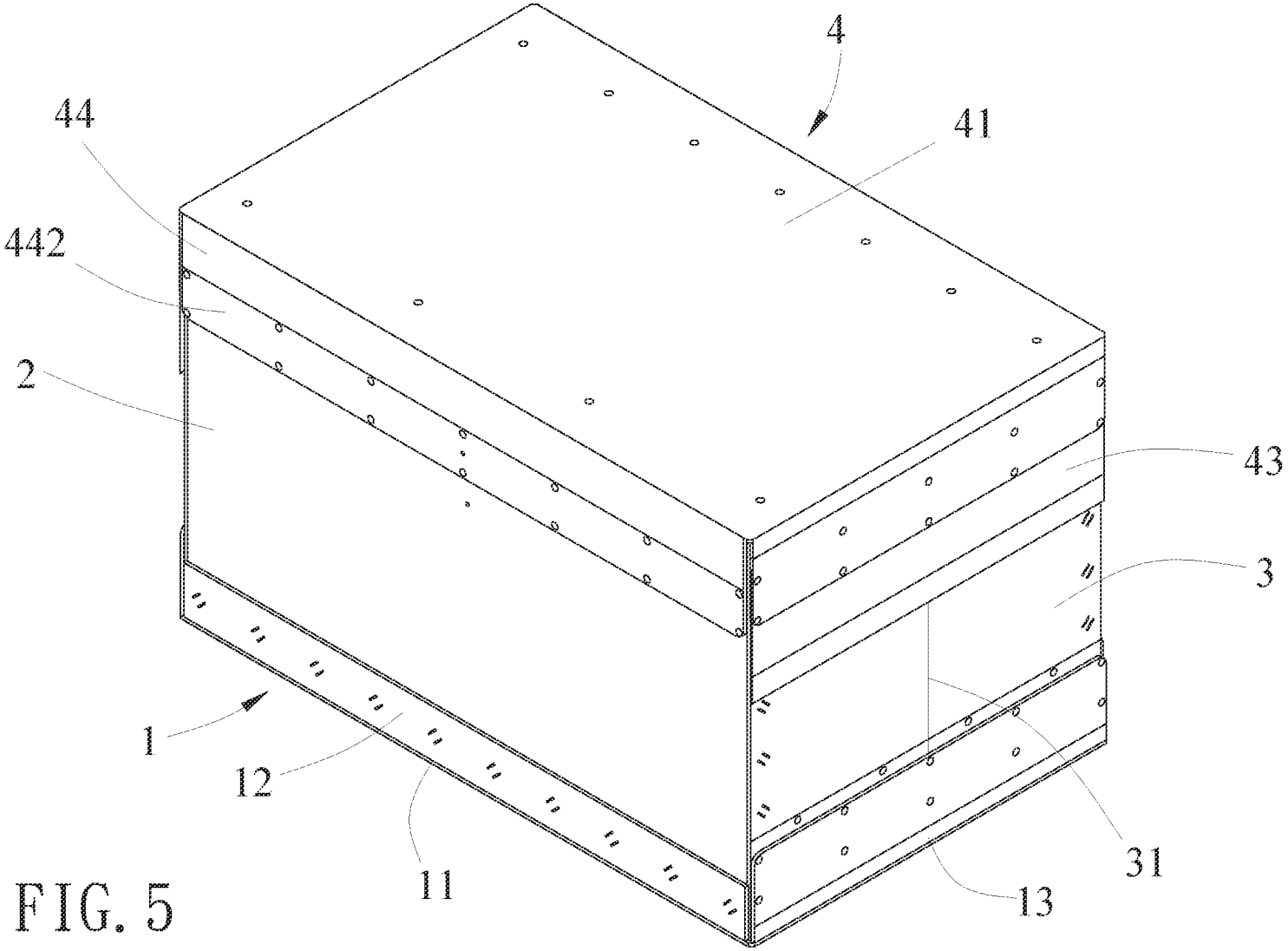
FIG. 5 is a perspective view of an embodiment in use after extension according to the present invention.

While being extended to form a container, place the bottom plate 11 of the lower base 1 between bottoms of the two side plates 3 and the fold the two bottom-plate laterally-extending pieces 13 extending from the two sides of the bottom plate 11 upward, as shown in FIG. 3. Then the two bottom-plate side-fixing touch fasteners 131 on the inner surface of the respective bottom-plate laterally-extending pieces 13 are attached and connected to the two side-plate lower-fixing touch fasteners 32 at the outer surface of the lower part of the respective side plates 3 correspondingly. And the bottom-plate rear extension piece 14 extending from the rear end of the bottom plate 11 is folded up and the bottom-plate rear-fixing touch fastener 141 on the inner surface of the bottom-plate rear extension piece 14 is attached and connected to the back-plate lower-fixing touch fastener 52 on the lower part of the outer surface of the back plate 5. Thereby users are allowed to put objects into a space formed among the bottom plate 11, the front plate 2, the two side plates 3, and the back plate 5. After the objects being put into the space, the cover plate 41 of the upper cover 4 is folded and disposed on the front plate 2 and the two side plates 3 for covering, as shown in FIG. 4. The cover-plate laterally-extending piece 43 extending from the two sides of the cover plate 41 are folded down and the two cover-plate side-fixing touch fastener 431 on the inner surface of the cover-plate laterally-extending piece 43 and the side-plate upper-fixing touch fasteners 34 of the side plates 3 are attached and connected to each other. At the same time, the two cover-plate side shielding touch fasteners 432 on the inner surface of the cover-plate laterally-extending piece 43 and the side-plate shielding touch fasteners 35 of the side plates 3 are also attached and connected to each other. Thereby waterproof effect is provided by the cover-plate laterally-extending piece 43 which covers the handle 331 of the side plate 3. Next the cover-plate front extension piece 44 extending from the front side of the cover plate 41 is folded downward to make the cover-plate covering touch fastener 441 on the inner surface of the cover-plate front extension piece 44 and the front-plate covering touch fastener 22 of the front plate 2 attach and connect to each other, as shown in FIG. 5. Owing to the bottom-plate foam layer 111 on the periphery of the top surface of the bottom plate 11 and the cover-plate foam layer 411 on the periphery of the inner surface of the cover plate 41, not only waterproof effect is achieved, slide control and positioning of the objects put into the space are also provided. By the bottom-plate reinforcement piece 112 and the cover-plate reinforcement piece 412 connected to the top surface of the bottom plate 11 and the inner surface of the cover plate 41 and located within the periphery of the top surface of the bottom plate 11 with the bottom-plate foam layer 111 and the periphery of the inner surface of the cover plate 41 with the cover-plate foam layer 411 respectively, strength of both the bottom plate 11 and the cover plate 41 is increased to keep them from collapsing. When users intend to move the present folding container, the two cover-plate side shielding touch fasteners 432 on the inner surface of the cover-plate laterally-extending pieces 43 and the side-plate shielding touch fasteners 35 of the side plates 3 are separated from each other and the two cover-plate laterally-extending pieces 43 are lifted. Thus the handles 331 on the respective side plates 3 are exposed and the user can hold the handles 331 for transportation conveniently.

Figure 6:
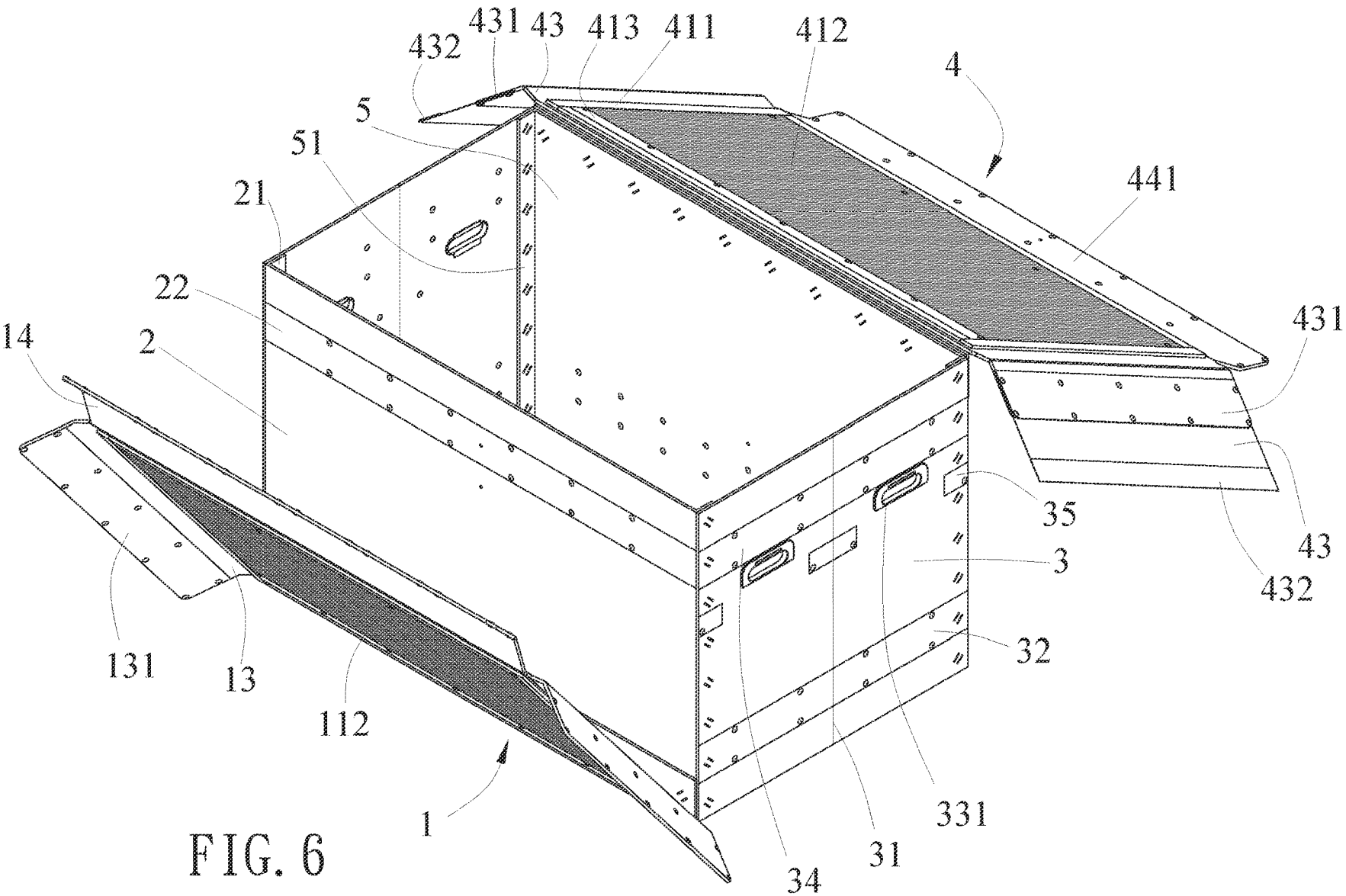
FIG. 6 is a schematic drawing showing an embodiment being folded according to the present invention.
Figure 7:
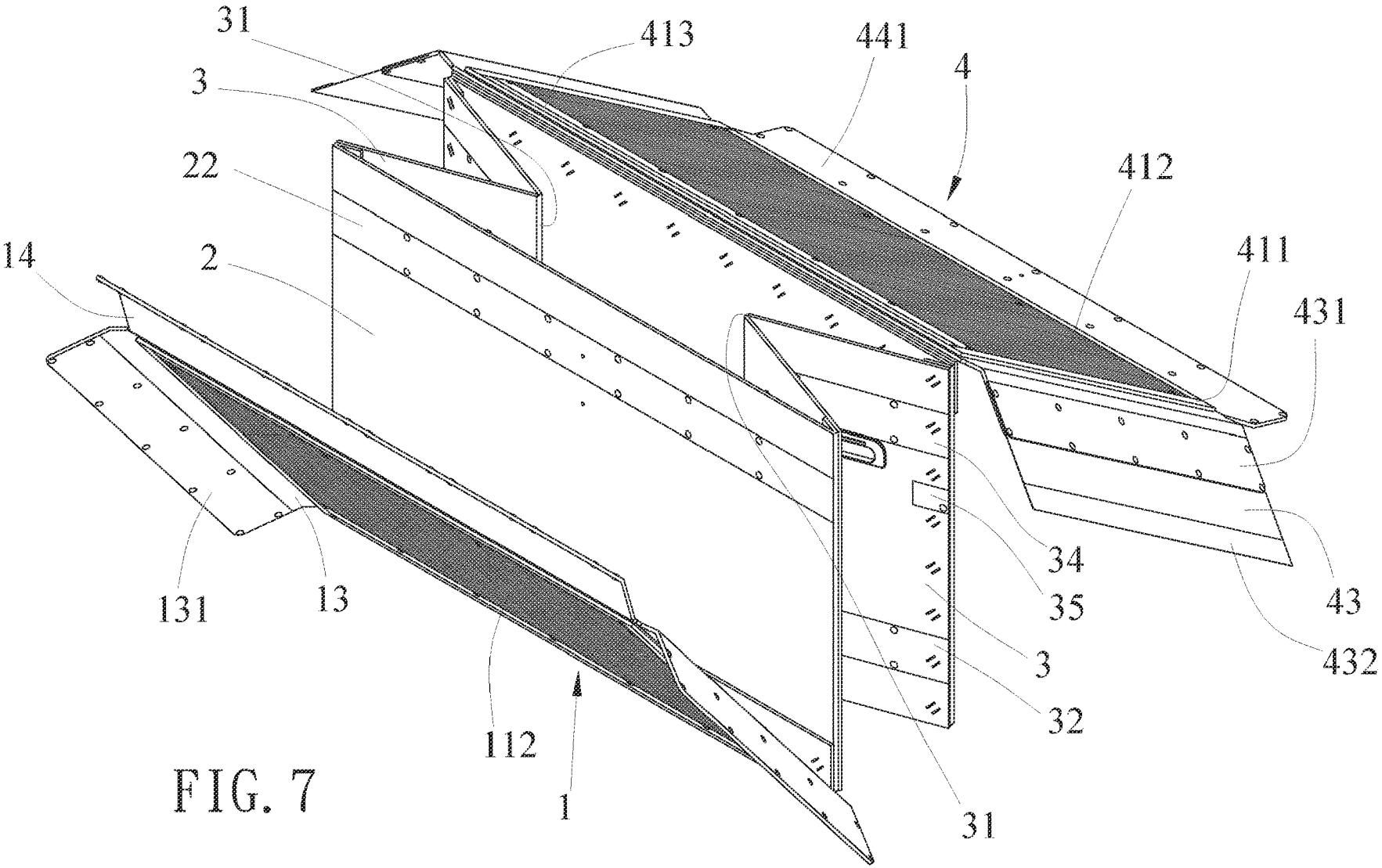
FIG. 7 is another schematic drawing showing an embodiment being folded according to the present invention.
Figure 8:
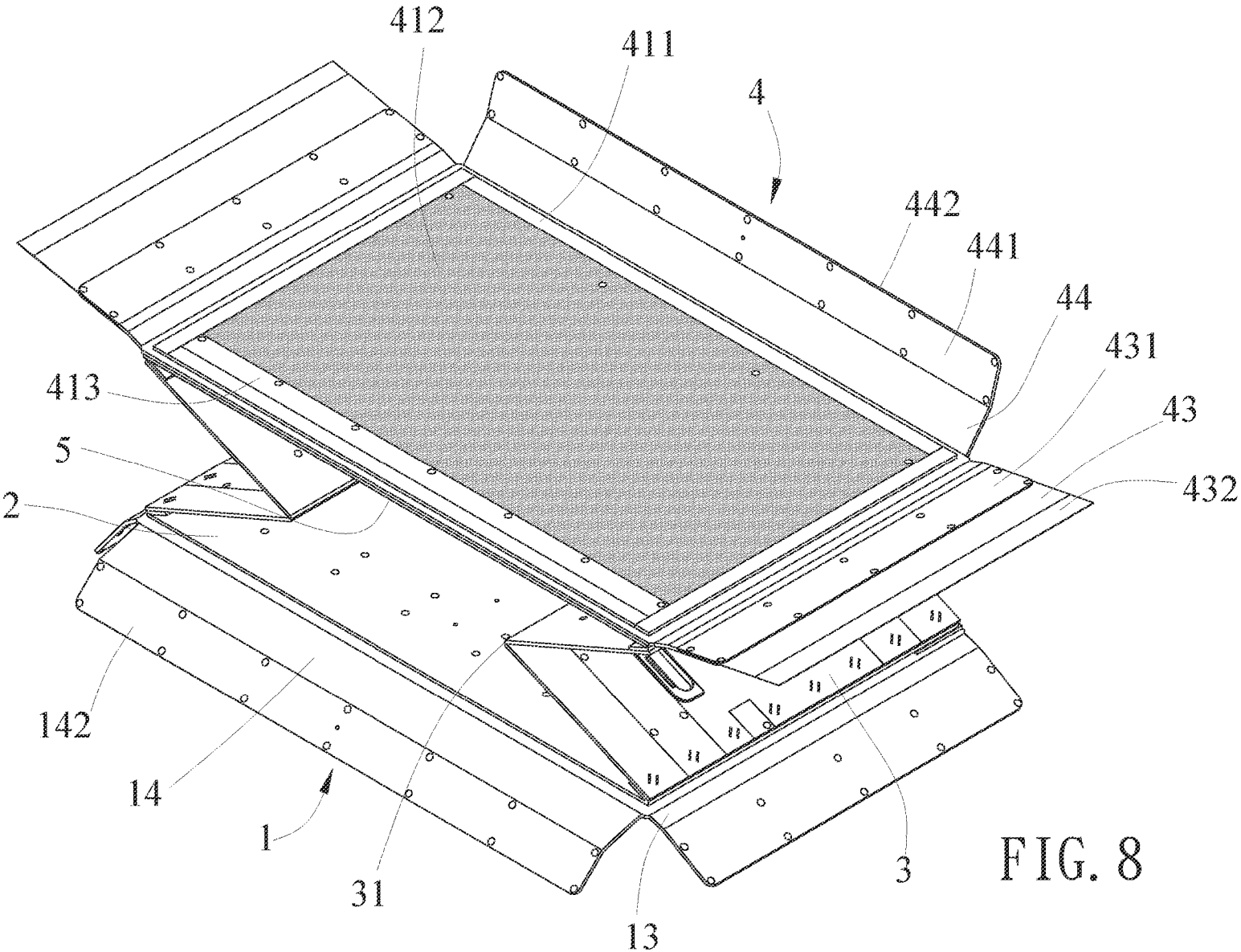
FIG. 8 is a further schematic drawing showing an embodiment being folded according to the present invention.
Figure 9:
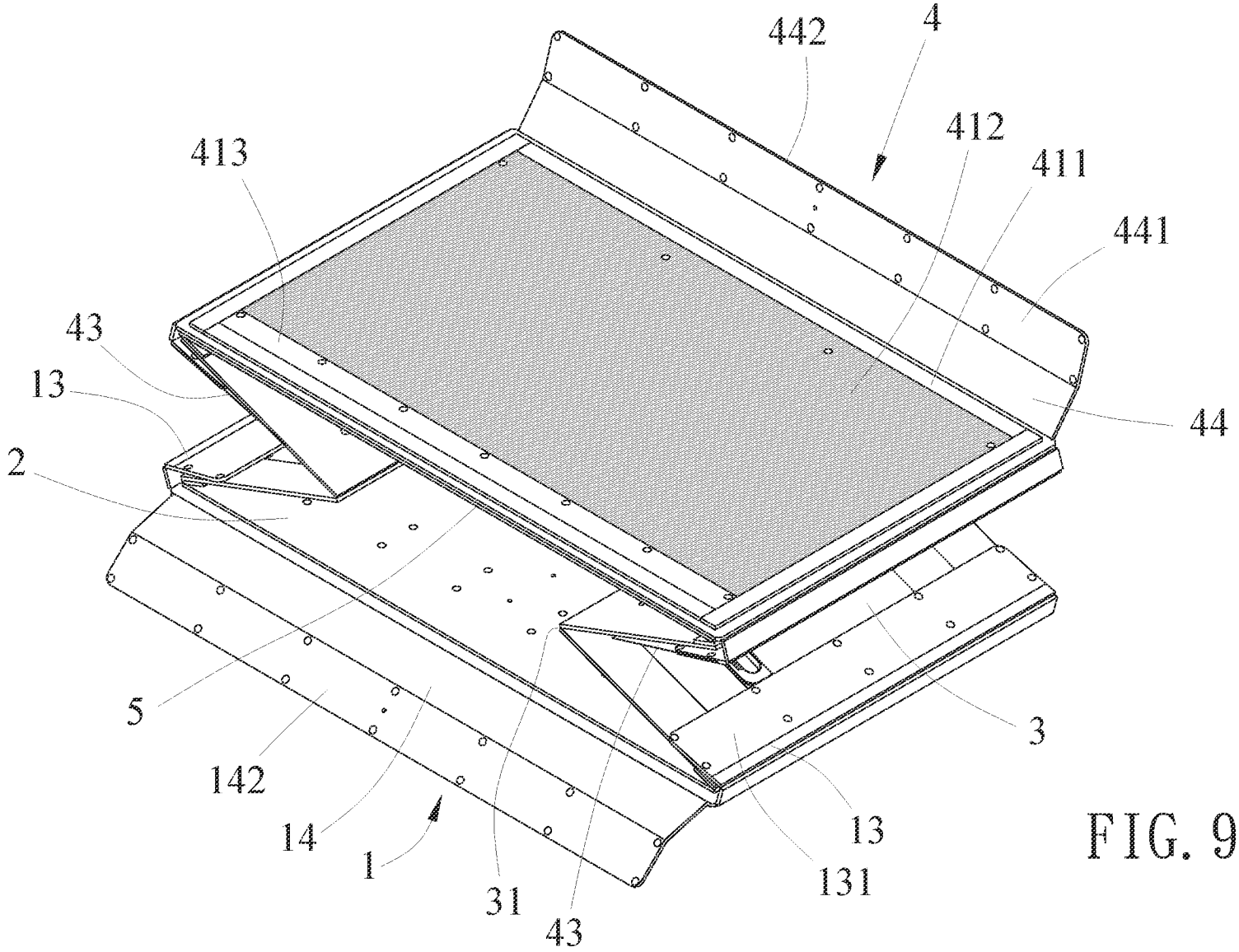
FIG. 9 is a further schematic drawing showing an embodiment being folded according to the present invention.
Figure 10:
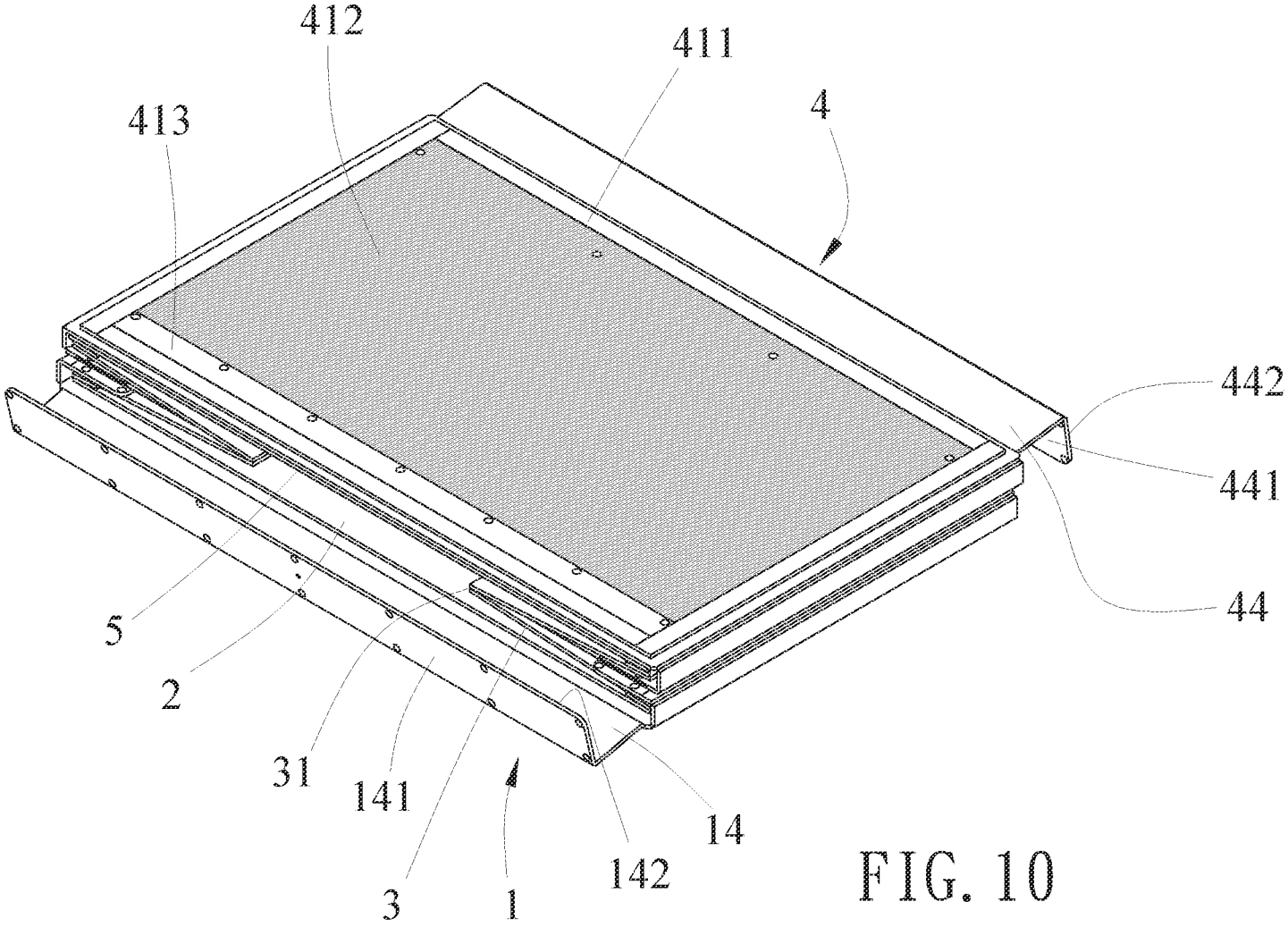
FIG. 10 is a further schematic drawing showing an embodiment being folded according to the present invention.
Figure 11:
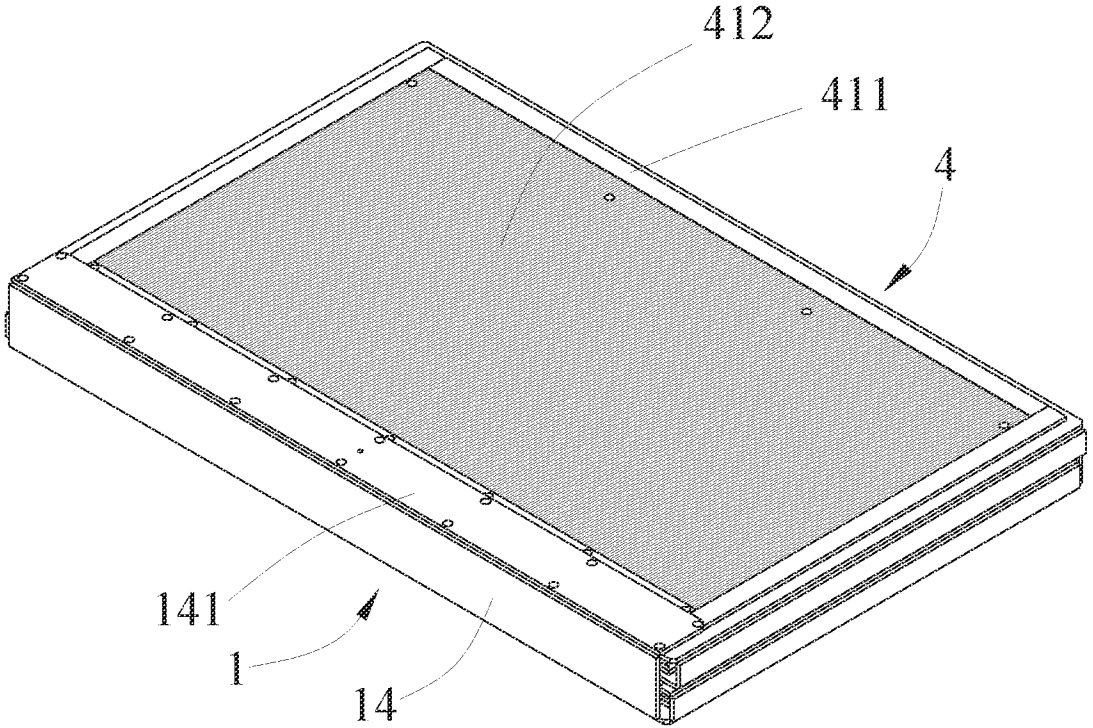
FIG. 11 is a perspective view of an embodiment after being folded according to the present invention.
Figure 12:
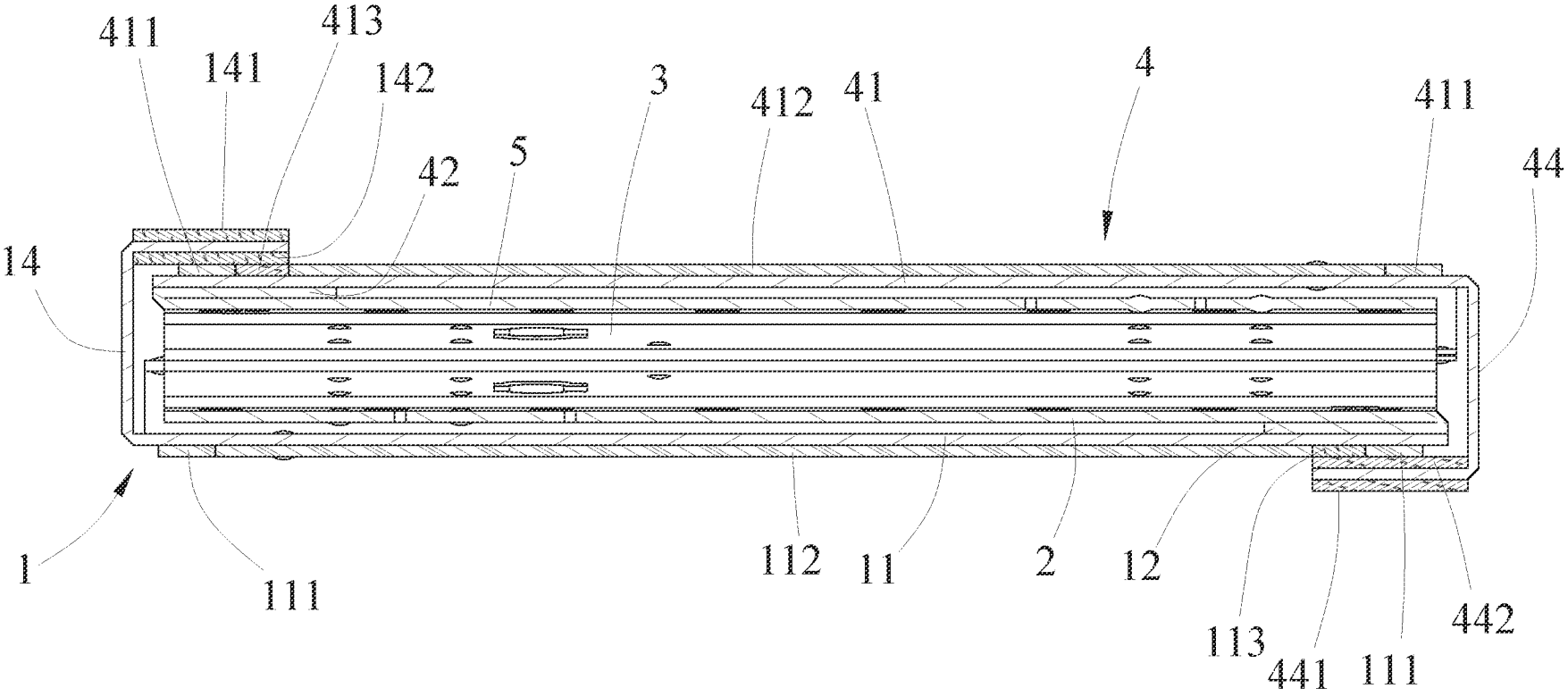
FIG. 12 is a sectional view of an embodiment already folded according to the present invention.

While not in use, the two bottom-plate laterally-extending pieces 13 on the two sides of the bottom plate 11 of the lower base 1 and the bottom-plate rear extension piece 14 on the rear end of the bottom plate 11 are respectively released from fastening with the side plates 3 and the back plate 5. Then the bottom plate 11 is folded toward a front surface of the front plate 2. The cover-plate laterally-extending pieces 43 on the two sides of the cover plate 41 of the upper cover 4 and the cover-plate front extension piece 44 on the front side of the cover plate 41 of the upper cover 4 are also respectively released from fastening with the side plates 3 and the front plate 2. Then the cover plate 41 is folded toward a back surface of the back plate 5, as shown in FIG. 6. Next each of the two side plates 3 is folded inward along the fold line 31 at the middle part of the side plate 3 so that the bottom plate 11, the side plates 3, and the cover plate 41 are folded and stacked into a flat structure, as shown in FIG. 7 and FIG. 8. Refer to FIG. 9 and FIG. 10, the two bottom-plate laterally-extending pieces 13 on the two sides of the bottom plate 11 and the cover-plate laterally-extending pieces 43 on the two sides of the cover plate 41 are both folded and hidden into folded area of the side plates 3. The bottom-plate rear extension piece 14 is folded toward the cover plate 41 and then the bottom-plate folding fixing touch fastener 142 and the cover-plate folding touch fastener 413 are attached and connected to each other while the cover-plate front extension piece 44 is folded toward the bottom plate 11 and then the cover-plate folding fixing touch fastener 442 and the bottom-plate folding touch fastener 113 are attached and connected to each other. Thereby the lower base 1, the side plates 3, and the upper cover 4 are folded and fixed, as shown in FIG. 11 and FIG. 12.

In summary, the present folding container is not only lighter in total weight and able to be folded into a compact form while not in use, but also positioned precisely to keep itself from extending freely during folding process compared with the techniques available now. Therefore, the present folding container is more convenient to use and more practical in use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A folding container comprising a lower base, a front plate, two opposite side plates, an upper cover, and a back plate;

wherein the lower base includes a bottom plate provided with a bottom-plate folding touch fastener arranged at a front end of the bottom plate, a foldable front-end connection piece extending from the front end of the bottom plate, two bottom-plate laterally-extending pieces extending from two sides of the bottom plate and each of which is provided with a bottom-plate side-fixing touch fastener, and a bottom-plate rear extension piece extending from a rear end of the bottom plate and provided with a bottom-plate rear-fixing touch fastener and a bottom-plate folding fixing touch fastener respectively disposed on an inner surface and an outer surface of the bottom-plate rear extension piece;

wherein the front plate in which a lower part thereof is connected and fixed to the front-end connection piece of the lower base is provided with a foldable front connecting piece for side-plate extending from each of two sides of the front plate, and a front-plate covering touch fastener arranged at an outer surface of an upper part of the front plate;

wherein the two side plates are disposed on two sides of the bottom plate of the lower base correspondingly and front ends of the two side plates are connected and fixed on the side-plate connection pieces on the two sides of the front plate correspondingly; wherein the side plate includes a fold line formed at a middle part thereof and along which the side plate is able to be folded, a side-plate lower-fixing touch fastener arranged at a lower part of an outer side of the side plate and corresponding to the bottom-plate side-fixing touch fastener of the bottom-plate laterally-extending piece for adhesion and connection to each other as the folding container is in use, at least one handle hole which is a through hole used for assembly of a handle and disposed on an upper part of the side plate, and a side-plate upper-fixing touch fastener disposed on the outer side of the side plate and located above the handle hole;

wherein the upper cover includes a cover plate provided with a cover-plate folding touch fastener arranged at a rear side of the cover plate and corresponding to the bottom-plate folding fixing touch fastener of the bottom-plate rear extension piece of the lower base for being attached and connected to each other during folding, a rear-end connection piece formed by the rear side of the cover plate being folded downward, two cover-plate laterally-extending pieces each of which is extending from one of the two sides of the cover plate correspondingly and provided with a cover-plate side-fixing touch fastener mounted to an inner surface of the cover-plate laterally-extending piece and corresponding to the side-plate upper-fixing touch fastener of the side plate for being attached and connected to each other as the folding container is in use, and a cover-plate front extension piece extending from a front side of the cover plate and provided with a cover-plate covering touch fastener and a cover-plate folding fixing touch fastener arranged at an inner surface and an outer surface of the cover-plate front extension piece and corresponding to the front-plate covering touch fastener of the front plate and the bottom-plate folding touch fastener of the bottom plate of the lower base respectively for being attached and connected to each other; the cover-plate covering touch fastener and the front-plate covering touch fastener are attached and connected to each other as the folding container is in use while the cover-plate folding fixing touch fastener and the bottom-plate folding touch fastener are attached and connected to each other during folding of the folding container;

wherein an upper part of the back plate is connected and fixed to the rear-end connection piece of the upper cover; the back plate includes two foldable rear connecting pieces for side plate and a back-plate lower-fixing touch fastener; the rear connecting piece for side-plate is extending from each of two sides of the back plate and connected and fixed to a rear end of the side plate correspondingly while the back-plate lower-fixing touch fastener is mounted to a lower part ofan outer surface of the back plate and corresponding to the bottom-plate rear-fixing touch fastener of the bottom-plate rear extension piece of the lower base for being attached and connected to each other as the folding container is in use.

2. The folding container as claimed in claim 1, wherein a bottom-plate foam layer is disposed on a periphery of a top surface of the bottom plate.

3. The folding container as claimed in claim 2, wherein a reinforcement plate is connected to the top surface of the bottom plate and located within the periphery of the top surface of the bottom plate with the bottom-plate foam layer.

4. The folding container as claimed in claim 1, wherein a type of connection between the front plate and the front-end connection piece, the side plate and the front connecting piece for side-plate, the back plate and the rear-end connection piece, and the side plate and the rear connecting piece for side-plate is selected from the group consisting of sewing, adhesion, and riveting.

5. The folding container as claimed in claim 1, wherein a type of connection between the bottom plate and the bottom-plate folding touch fastener, the bottom-plate laterally-extending piece and the bottom-plate side-fixing touch fastener, the bottom-plate rear extension piece and the bottom-plate rear-fixing touch fastener, the bottom-plate rear extension piece and the bottom-plate folding fixing touch fastener, the front plate and the front-plate covering touch fastener, the side plate and the side-plate lower-fixing touch fastener, the side plate and the side-plate upper-fixing touch fastener, the cover plate and the cover-plate folding touch fastener, the cover-plate laterally-extending piece and the cover-plate side-fixing touch fastener, the cover-plate front extension piece and the cover-plate covering touch fastener, the cover-plate front extension piece and the cover-plate folding fixing touch fastener, the back plate and the back-plate lower-fixing touch fastener is selected from the group consisting of sewing, adhesion, and riveting.

6. The folding container as claimed in claim 1, wherein at least one side-plate shielding touch fastener is disposed on the outer side of the side plate and located below the handle hole while at least one cover-plate side shielding touch fastener is arranged at the inner surface of the cover-plate laterally-extending piece and corresponding to the side-plate shielding touch fastener for being attached and connected to each other as the folding container is in use.

7. The folding container as claimed in claim 6, wherein a type of connection between the side plate and the side-plate shielding touch fastener, and the cover-plate laterally-extending piece and the cover-plate side shielding touch fastener is selected from the group consisting of sewing, adhesion, and riveting.

8. The folding container as claimed in claim 1, wherein a cover-plate foam layer is disposed on a periphery of an inner surface of the cover plate.

9. The folding container as claimed in claim 8, wherein a cover-plate reinforcement piece is connected to the inner surface of the cover plate and located within the periphery of the inner surface of the cover plate with the cover-plate foam layer.

10. The folding container as claimed in claim 1, wherein the bottom-plate laterally-extending piece and the cover-plate extension piece are both folded and hidden into folded area of the side plate when the side plate is folded inward along the fold line at the middle of the side plate.

* * * * *